US009459045B2

(12) United States Patent
Priero

(10) Patent No.: US 9,459,045 B2
(45) Date of Patent: Oct. 4, 2016

(54) DRYING APPARATUS FOR DRYING CONTAINERS

(71) Applicant: EUROPOOL S.R.L., Fidenza (Parma) (IT)

(72) Inventor: Marco Priero, Fidenza (IT)

(73) Assignee: EUROPOOL S.R.L., Fidenza (IT)

( * ) Notice: Subject to any disclaimer, the term of this patent is extended or adjusted under 35 U.S.C. 154(b) by 65 days.

(21) Appl. No.: 14/686,120

(22) Filed: Apr. 14, 2015

(65) Prior Publication Data

US 2015/0300739 A1 Oct. 22, 2015

(30) Foreign Application Priority Data

Apr. 16, 2014 (IT) ..... PR2014A0025

(51) Int. Cl.
*F26B 15/00* (2006.01)
*F26B 15/04* (2006.01)
*F26B 21/00* (2006.01)

(52) U.S. Cl.
CPC ..... *F26B 15/04* (2013.01); *F26B 21/004* (2013.01)

(58) Field of Classification Search
CPC ..... F26B 5/00; F26B 11/00; F26B 15/00; F26B 19/00; F26B 21/00; F26B 21/06; B01D 47/00; B01D 53/00; B41F 23/00
USPC ..... 34/104, 105, 203; 219/746, 749; 432/122
See application file for complete search history.

(56) References Cited

U.S. PATENT DOCUMENTS 4,053,993 A * 10/1977 Schregenberger .... B41F 23/005 34/105
4,154,624 A * 5/1979 Wahl ..... B08B 9/28 134/10
4,683,009 A * 7/1987 Shriver ..... B08B 9/20 134/105
5,159,960 A * 11/1992 Pringle ..... B08B 1/00 141/1
5,271,161 A * 12/1993 Brinck, II ..... C12H 1/22 34/105
5,271,164 A * 12/1993 Yoshimura ..... F26B 5/12 15/304
5,441,063 A * 8/1995 Fernandez ..... B08B 9/32 134/142
5,675,913 A * 10/1997 Matsuda ..... F26B 13/145 34/526
5,749,156 A * 5/1998 Mokler ..... F26B 21/004 34/105
6,101,739 A * 8/2000 Rutz ..... B01D 53/34 34/373
8,061,056 B2 * 11/2011 Hedberg ..... B01D 1/14 118/320
8,186,076 B2 * 5/2012 Takagi ..... H05B 6/78 219/746
8,959,793 B2 * 2/2015 Zea ..... F26B 3/04 165/104.21
2015/0300739 A1 * 10/2015 Priero ..... F26B 21/004 34/105

FOREIGN PATENT DOCUMENTS

EP 1927547 A1 6/2008
EP 2072405 A1 6/2009
FR 2536516 A1 5/1984
IT WO 9010587 A1 * 9/1990 ..... B65G 51/035
IT WO 9709255 A1 * 3/1997 ..... B65G 17/26
IT EP 1927547 A1 * 6/2008 ..... B65C 9/0015
IT EP 2072405 A1 * 6/2009 ..... B65C 9/0015

* cited by examiner

*Primary Examiner* — Stephen M Gravini
(74) *Attorney, Agent, or Firm* — Pearne & Gordon LLP

(57) ABSTRACT

Drying apparatus (1) for drying containers (1), comprising: a rotating carousel (4);
a plurality of drying stations (3) that extend along the circumference on the rotating carousel (4), a plate (5) rotating about its axis of symmetry (A) and at least one air dispenser (8) that sends air towards the container (2) resting on the plate (5) being located in each drying station (3).

11 Claims, 12 Drawing Sheets

DRYING APPARATUS FOR DRYING CONTAINERS

The object of the present invention is a drying apparatus for drying containers, for use in the bottling sector of fluids.

In particular, in an industrial bottling process for fluid products, the drying unit for drying the containers is located downstream of the container filling unit and upstream of the container labelling unit.

There are already known drying apparatuses comprising a tunnel within which the containers are moved forward linearly, for example by means of a belt conveyor, and simultaneously subjected to jets of air (preferably hot air) dispensed by nozzles. In this manner, the containers at the tunnel exit exhibit dry and slightly warm external surfaces, a condition that affords optimal application of the labels in a subsequent step.

Such a drying tunnel is described for example in patent no. EP1927547 filed by the Applicant.

Patent no. EP2072405, also filed by the Applicant, discloses a drying tunnel in which the nozzles are anchored to a rod, the ends of which are vertically movable so as to adjust the positioning of the nozzles.

The main disadvantage of prior-art drying tunnels is related to the fact that for high processing speeds there is a marked increase in dimensions and in the installed power. By way of example, consider that to dry approximately 60000 half-liter bottles per hour, a tunnel of approximately 6 meters and a generator power of about 45 kW are required. Furthermore, even with changes in the orientation of the nozzles, there is a risk that some portions of the external surface of the containers will not be reached by the jets of air, or that they will be only partially touched by it. Given that such skipped areas are not dried and heated in an optimal manner, they do not lend themselves to proper adhesion of the labels.

A drying apparatus having all the features recited in the preamble of claim 1 is known from document FR2536516.

This apparatus comprises a rotating carousel bearing a plurality of drying stations having rotating plates on which the containers rest. The air comes from fixed conduits afforded in the distributor central to the carousel obliquely with respect to the external walls of the containers.

In this context, the technical task underlying the present invention is to offer a drying apparatus for drying containers that overcomes the above-mentioned drawbacks of the prior art.

In particular, an aim of the present invention is to offer a drying apparatus for drying containers that is more compact and less wasteful in terms of power.

Another aim of the present invention is to offer a drying apparatus for drying containers that is capable of drying the external surface of the containers in a uniform manner.

The defined technical task and the specified aims are substantially achieved by a drying apparatus for drying containers, comprising:

a plurality of drying stations;

a plurality of rest supports for resting the bottom of the containers, each one of said rest supports being located in a corresponding drying station;

rotation means that are operatively active on said rest supports for rotating them about their axis of symmetry;

a plurality of primary dispensers of air, located at said drying stations in such a manner as to send air onto the containers placed on said rest supports;

a rotating carousel, said rest supports being arranged along a first arc on said rotating carousel in such a manner as to follow the circumferential length of said rotating carousel at least for a pre-established angular portion, said primary dispensers being integrally mounted on said rotating carousel and extending along a second arc, which is concentric with said first arc, characterised in that it further comprises adjustment means for adjusting the orientation of said primary dispensers for the purpose of changing the direction of the jet of air sent onto the containers.

Preferably, in the proposed drying apparatus, the radius of the second arc is smaller than the radius of the first arc.

Preferably, the rest supports (or plates) follow the entire circumferential length of said rotating carousel so that the first arc consists of a complete circumference.

Preferably, the primary dispensers also follow the entire circumferential length of the rotating carousel so that the second arc consists of a complete circumference.

Preferably, the drying apparatus for drying the containers thus comprises a rotating carousel and a plurality of drying stations that extend along the circumference on the rotating carousel. A plate rotating about its axis of symmetry and at least one air dispenser that sends air towards the container resting on the plate are located in each drying station.

Preferably, the drying apparatus comprises an air distributor located at the centre of said rotating carousel.

Preferably, the primary dispensers are connected to said air distributor by means of flexible primary lines.

Preferably, the orientation adjustment means are configured in such a manner as to enable a change at least in the inclination of each primary dispenser with respect to the rotating carousel and the rotation of the primary dispenser on itself.

In a first embodiment, each primary dispenser extends prevalently along a longitudinal direction and is provided with a first opening for dispensing air towards the body of the container placed on the corresponding plate and with a second opening for dispensing air towards the area of the neck of the container placed on the corresponding plate.

In a second embodiment, in each drying station there is a lower primary dispenser suitable for sending air towards the body of the container placed on the corresponding plate and an upper primary dispenser suitable for sending air towards the body and towards the area of the neck of the container placed on the corresponding plate.

In a third embodiment, secondary dispensers located externally of the plates are also provided for each drying station.

The containers are preferably kept on the plates by means of spring-loaded bells that act upon the caps.

Further characteristics and advantages of the present invention will become more apparent from the approximate and thus non-limiting description of a preferred, but not exclusive, embodiment of a drying apparatus for drying containers, as illustrated in the accompanying drawings, wherein:

FIG. 1*a* illustrates a drying apparatus for drying containers, according to the present invention, in a schematic view from above;

FIG. 1*b* illustrates the drying appliance appearing in FIG. 1*a* in a perspective view from above;

FIG. 2*a* illustrates a part (primary dispenser) of the drying apparatus of FIG. 1*a*, located alongside a bottle, according to a first embodiment, in a side view;

FIG. 2*b* illustrates the primary dispenser of FIG. 2*a*, located alongside a bottle, in a different side view;

FIG. 2*c* illustrates the primary dispenser of FIG. 2*a*, located alongside a bottle, in a view from above;

FIG. 3*a* illustrates two primary dispensers (upper and lower) of the drying apparatus of FIG. 1*a*, located alongside a bottle, in a second embodiment, in a side view;

FIG. 3*b* illustrates the lower primary dispenser of FIG. 3*a*, in a perspective view;

FIG. 3*c* illustrates the upper primary dispenser of FIG. 3*a*, in a perspective view;

Figure 1A:
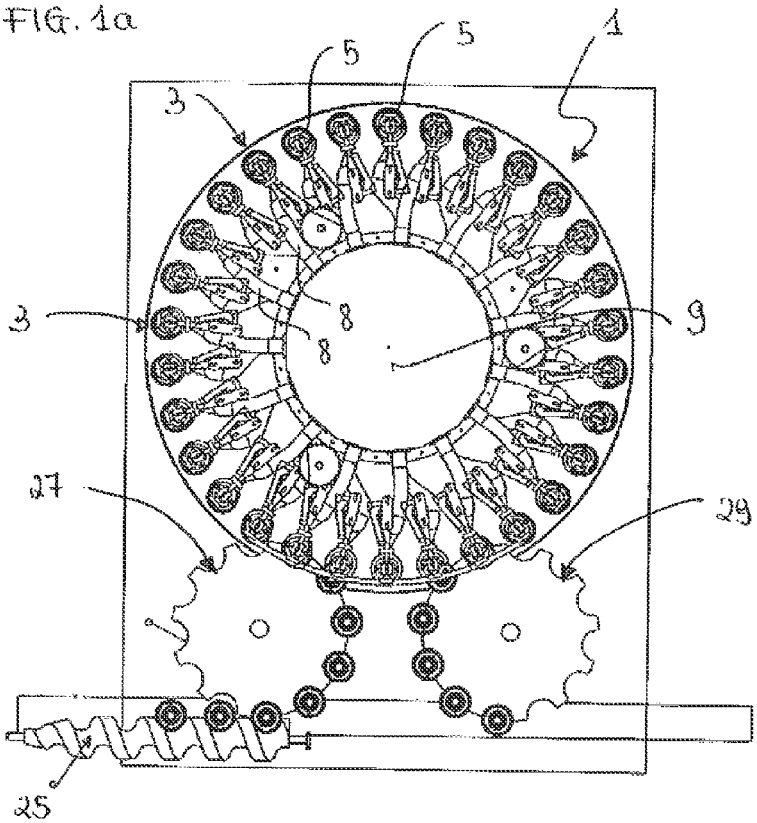

With reference to the figures, a drying apparatus for drying containers 2, for example glass or PET containers, is indicated by the number 1. In particular, the containers 2 are bottles made of glass or PET. Each bottle 2 has a mouth to which a cap 28 is applied.

The drying apparatus 1 comprises a plurality of drying stations 3.

Originally, the drying stations 3 are arranged on a rotating carousel 4.

A rest support 5 suitable for receiving the bottom 2*a* of a bottle 2 is located in each drying station 3. In particular, the rest support 5 is constituted by a plate, for example a disk-shaped plate.

Figure 11:
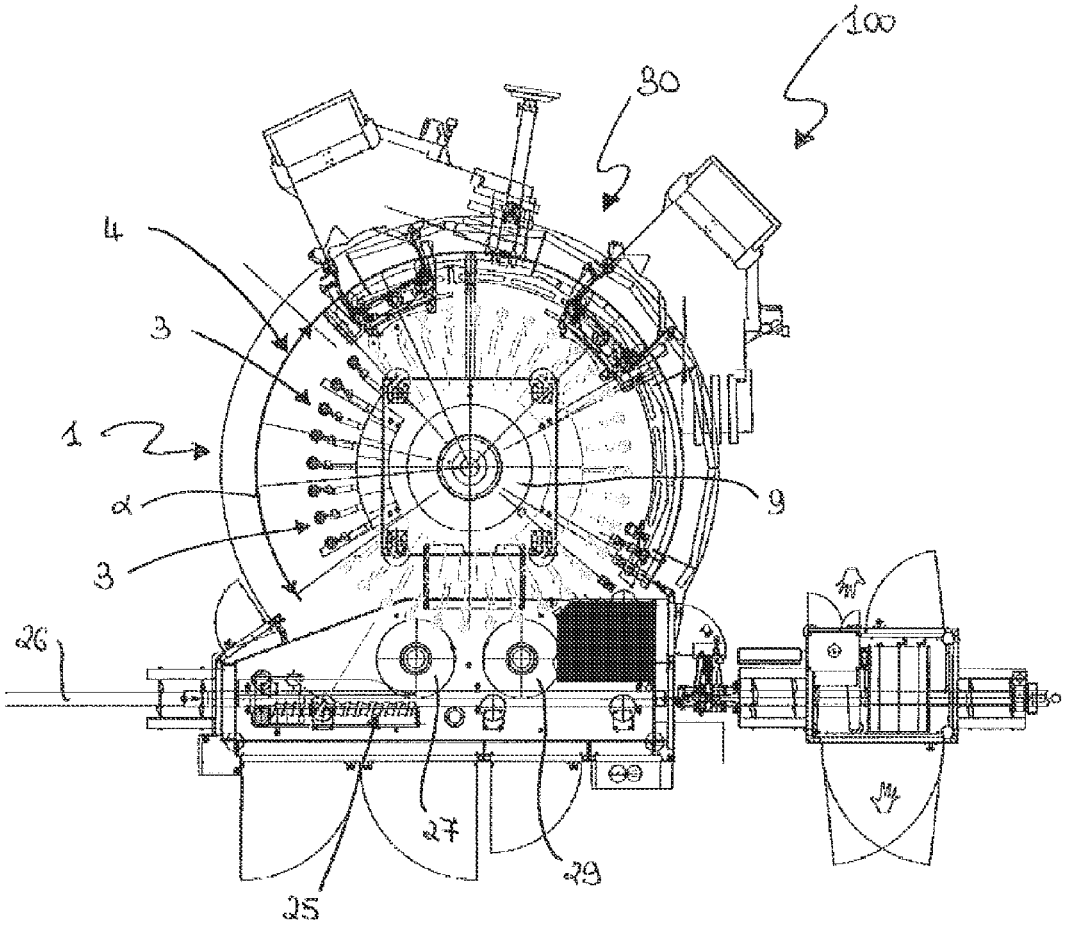
FIGS. 11-16 illustrate different variants of an integrated plant system for drying and labelling containers, in a schematic view from above.
Figure 12:
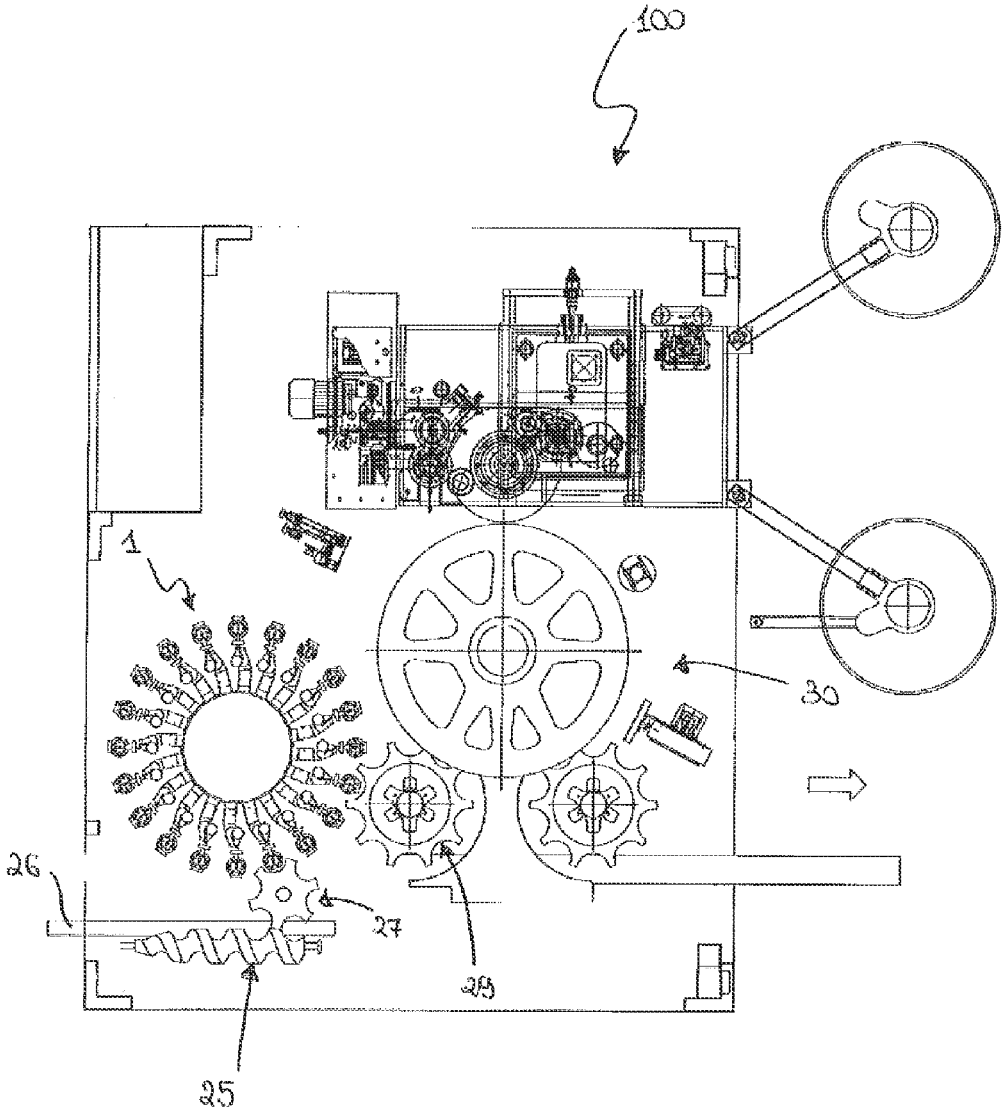
Figure 13:
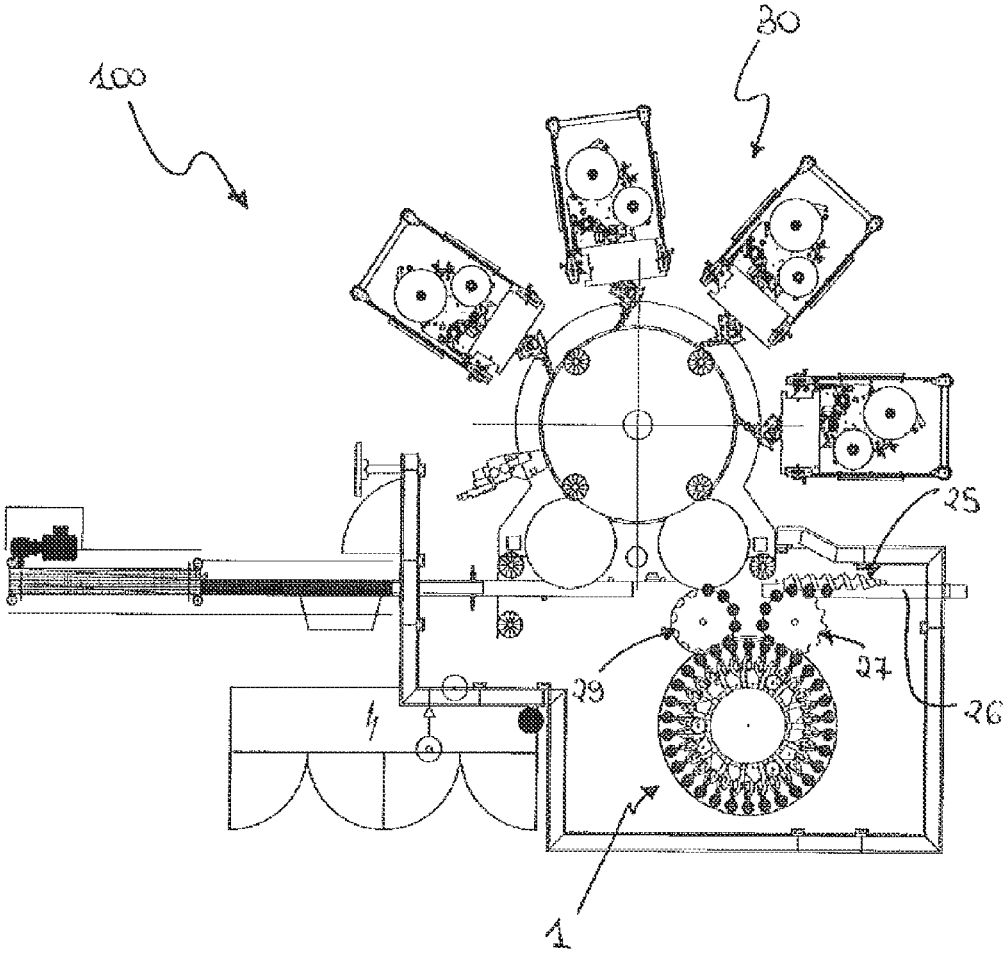
Figure 14:
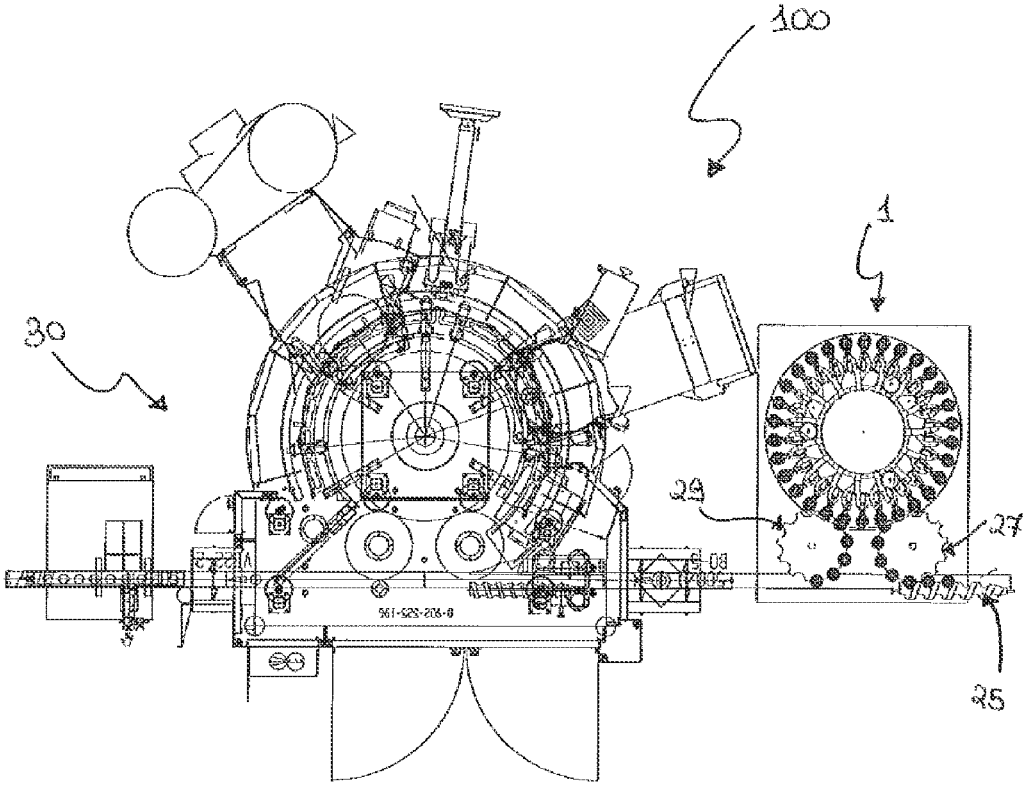
Figure 15:
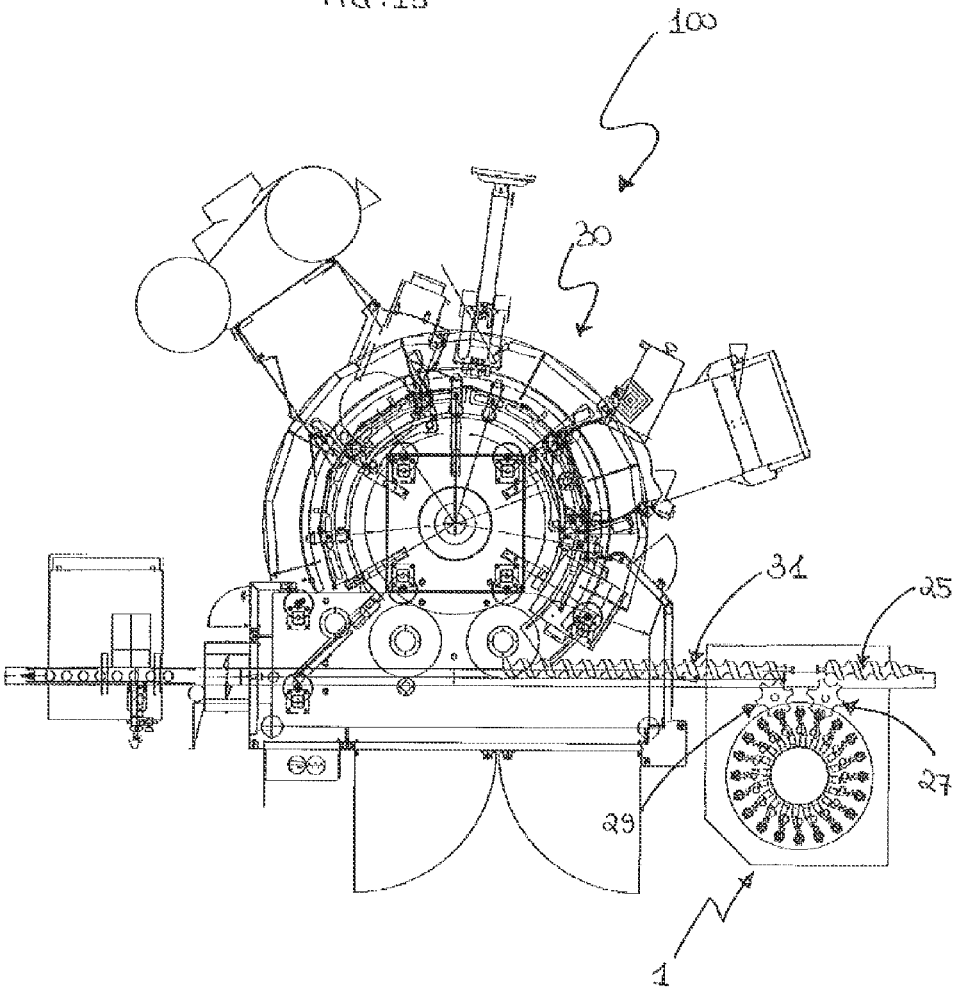
Figure 16:
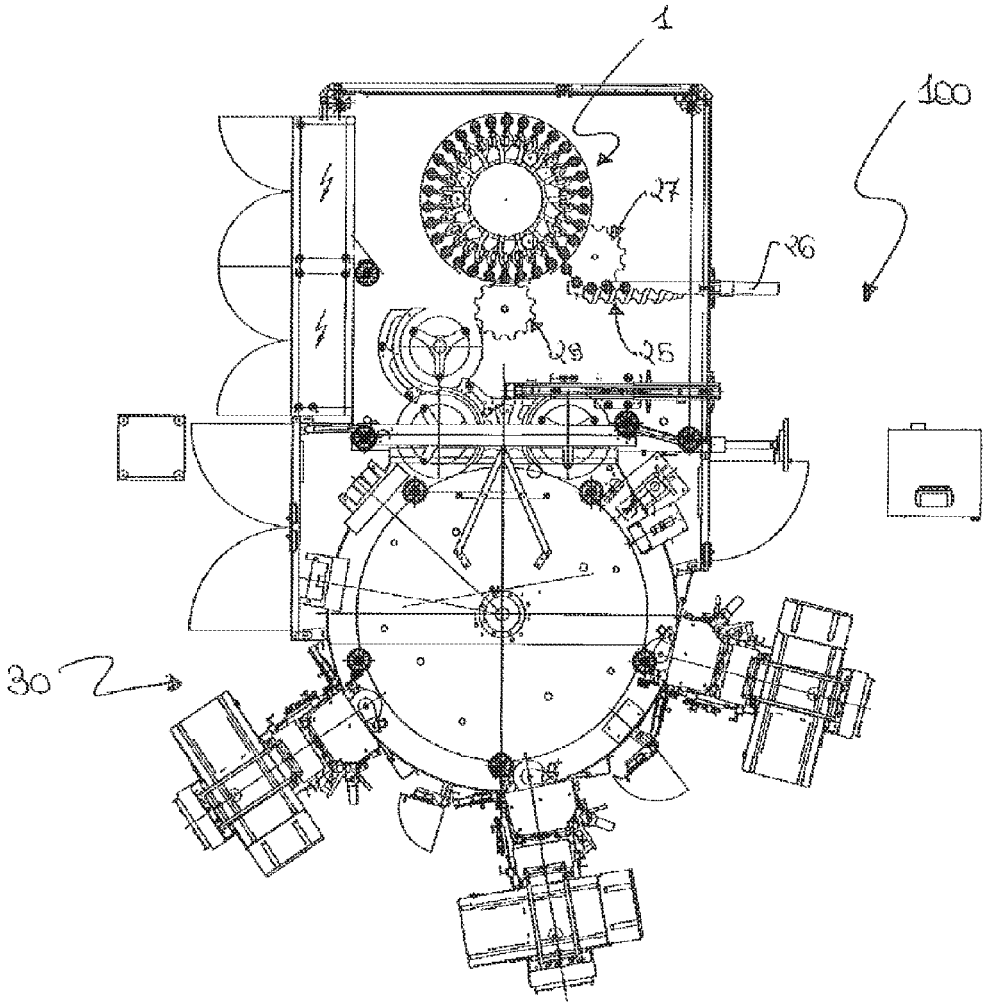

The plates 5 follow the circumferential length of the rotating carousel 4 at least for a pre-established angular portion, as can be seen in FIG. 11.

In fact, the plates 5 are arranged along a first arc. The pre-established angular portion preferably sweeps an angle $\alpha$ of at least 10°.

The rotating carousel 4 preferably comprises a lower plane surface 4*a* and an upper plane surface 4*b*.

Figure 9:
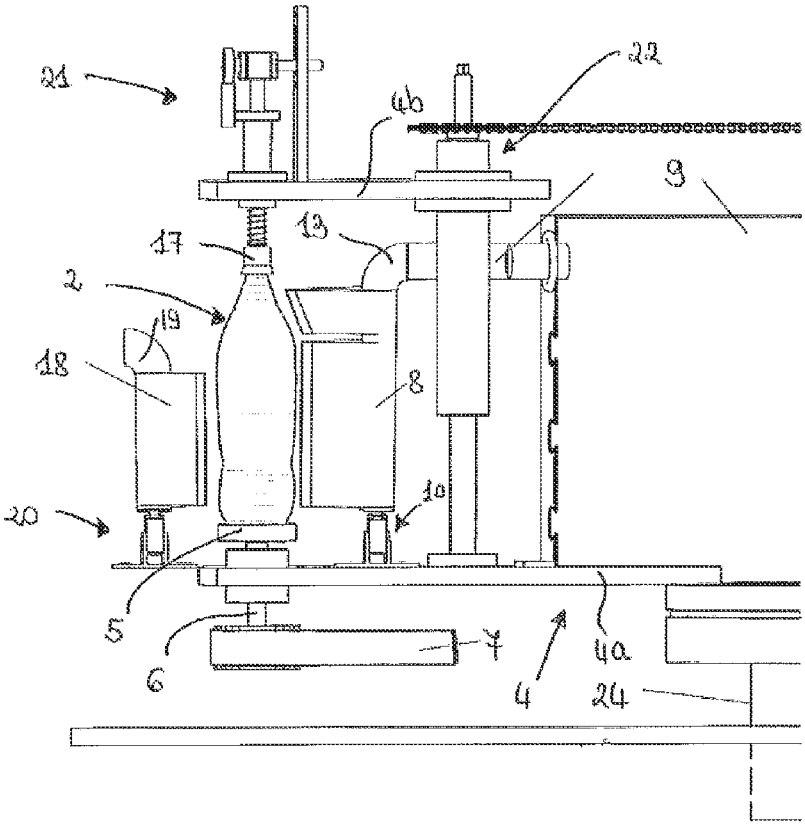
FIG. 9 illustrates half of the drying station of FIG. 5, in a side view.

As shown in FIG. 9, the plates 5 are constrained to the lower plane surface 4*a* of the rotating carousel 4. Advantageously, rotation means 6, 7 for rotating the plates 5 are present for the purpose of rotating the plates about their axis of symmetry A. For example, each plate 5 is supported by a first shaft 6 that is rotated by a motor (unillustrated) by means of a toothed belt 7. As can be seen in FIG. 9, the first shaft 6 passes through the lower plane surface of the rotating carousel 4, whereas the toothed belt 7 (and the motor) is located underneath this lower plane surface 4*a*.

The upper plane surface 4*b* of the rotating carousel 4 is located at a predefined distance from the lower plane surface 4*a*.

This predefined distance is adjustable according to the size (i.e., the height) of the bottles 2 to be treated. In particular, the drying apparatus 1 comprises means 22 of a known type for changing the predefined distance between the plane surfaces 4*a*, 4*b* of the rotating carousel 4.

The drying apparatus 1 comprises a plurality of primary dispensers 8 located at the drying stations 3 in such a manner as to send air onto the bottles 2 placed on the plates 5. In this sector, these primary dispensers 8 are also known by the technical term "lances".

In particular, the primary dispensers 8 are integrally mounted on the rotating carousel 4. Preferably, the primary dispensers 8 are arranged along a second arc, which is concentric with the first arc along which the plates 5 are arranged.

An air distributor 9, to which the primary dispensers 8 are connected, is located at the centre of the rotating carousel 4.

Figure 1B:
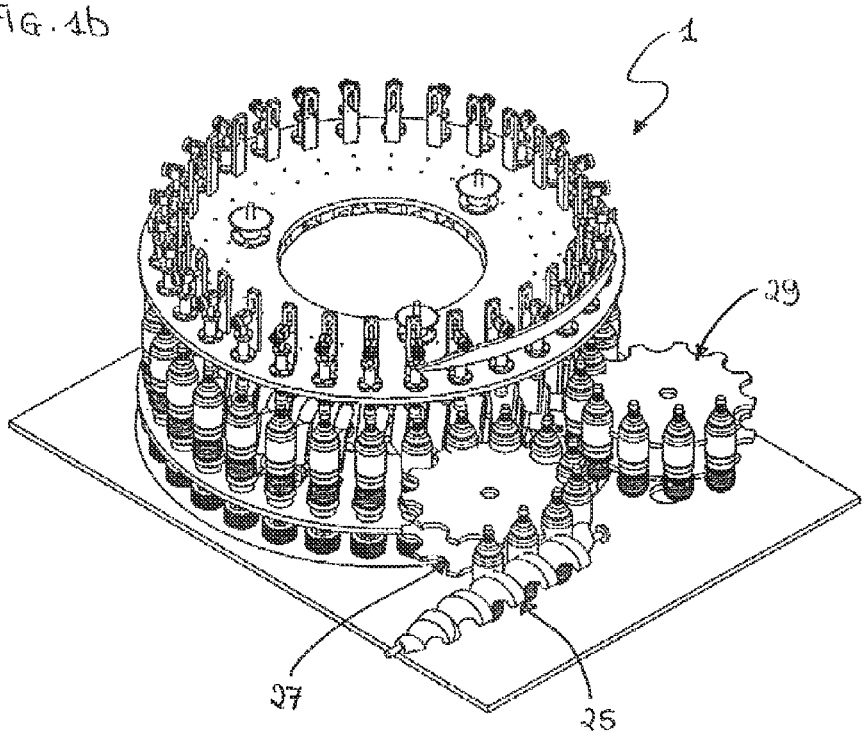

The radius of the second arc is preferably smaller than the radius of the first arc (see FIG. 1). In other words, the second arc lies within the first arc, that is, the primary dispensers 8 are interposed between the air distributor 9 and the plates 5.

The air generated by a generator 23 located above or below the rotating carousel 4 is sent to a rotary manifold 24 that is connected to the air distributor 9. The air generator 23 is of a known type and is therefore not described further herein.

Preferably, a heating circuit (unillustrated) for heating the generated air is also present. Advantageously, adjustment means 10 for adjusting the orientation of the primary dispensers 8 are provided for the purpose of changing the direction of the jet of air sent onto the containers 2.

In a first embodiment, the number of primary dispensers 8 is equal to the number of drying stations 3. A respective primary dispenser 8 is located in each drying station 3, which extends prevalently along a longitudinal direction and is provided with openings 11, 12 for dispensing air towards various areas of the container 2.

In particular, each primary dispenser 8 has:

- a first opening 11 for dispensing air towards the body of the container 2 placed on the corresponding plate 5;
- a second opening 12 for dispensing air towards the area of the neck 2*b* of the container 2 placed on the corresponding plate 5.

Figure 2A:
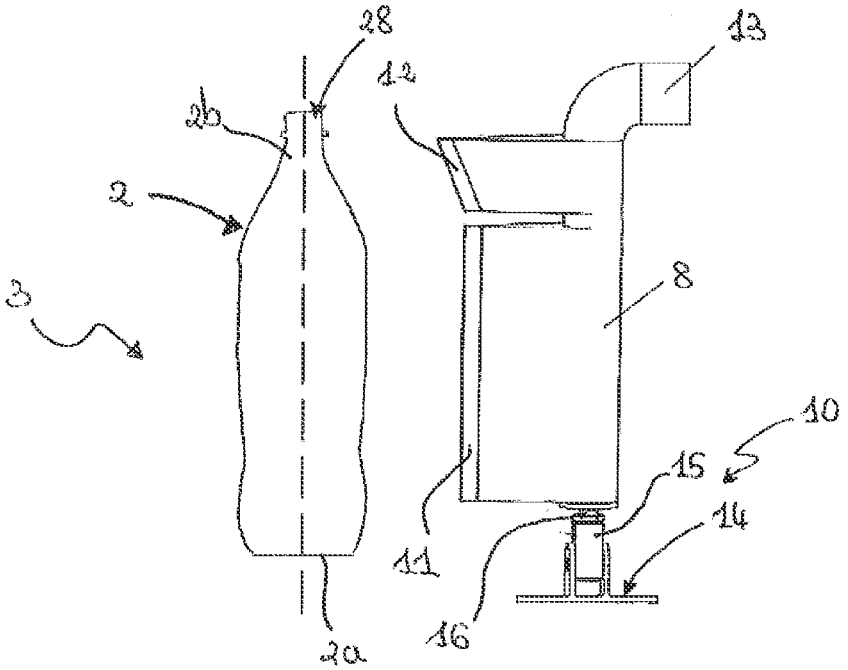
Figure 2B:
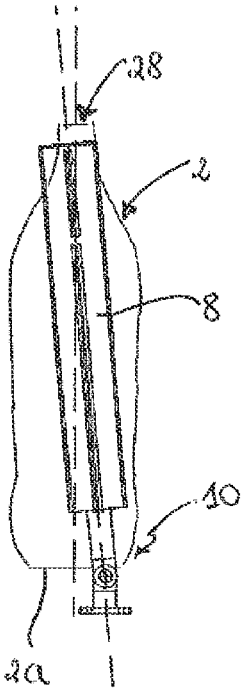
Figure 2C:
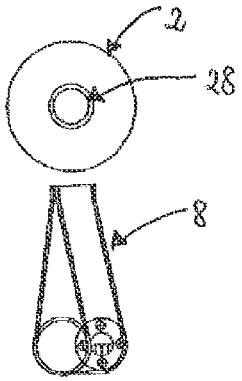

The first embodiment is illustrated in FIGS. 2*a* to 2*c*.

Preferably, the primary dispensers 8 receive air from the distributor 9 by means of an equal number of primary lines 13. The primary lines 13 are preferably flexible.

The orientation adjustment means 10 for each primary dispenser 8 is configured in such a manner as to enable at least:

- a change in the inclination of the primary dispenser 8 with respect to the lower plane surface 4*a* of the rotating carousel 4;
- the rotation of the primary dispenser 8 on itself.

A change in inclination is obtained by means of a hinge constraint.

In particular, this hinge constraint is in the form of a bracket 14 that is fixed to the lower plane surface 4*a* of the rotating carousel 4 and to which a support block 15 supporting the primary dispenser 8 is hinged. In particular, the block 15 comprises a second rotating shaft 16 that supports the primary dispenser 8. It is this second shaft 16 that enables the primary dispenser 8 to rotate on itself.

Figure 3A:
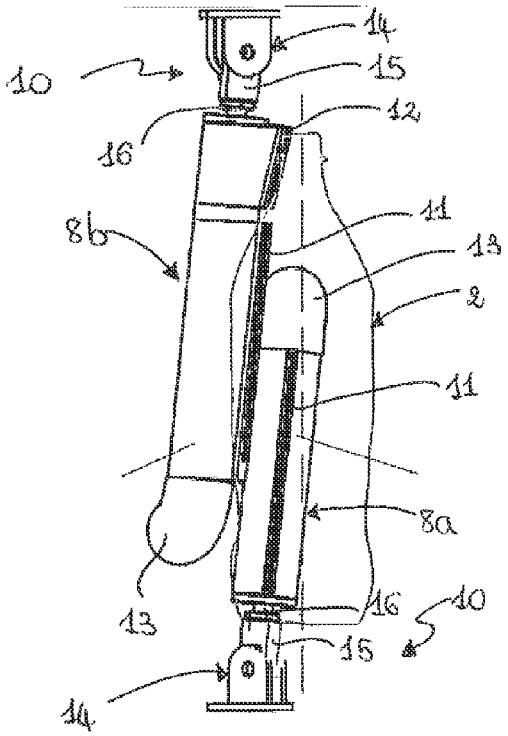
Figure 3C:
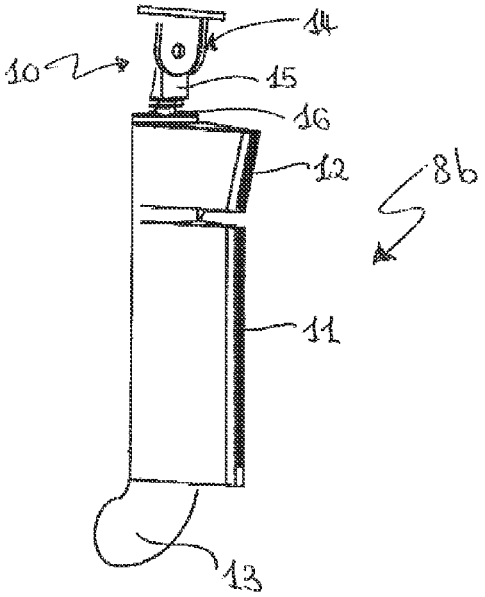
Figure 3B:
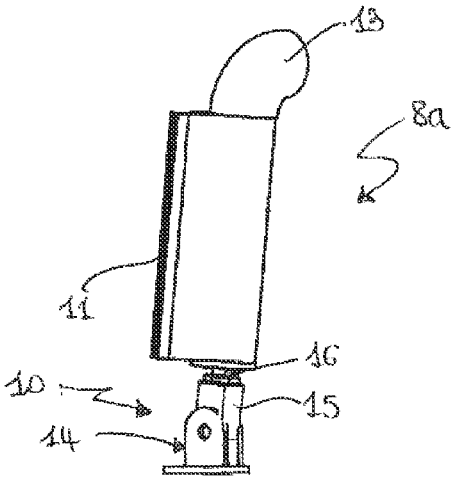
Figure 10:
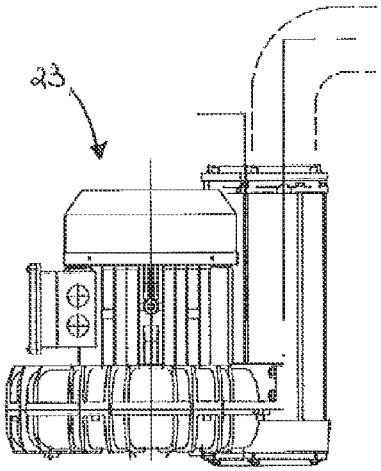
FIG. 10 illustrates a part (air generator) of the drying station of FIG. 5, in a side view.
Figure 4:
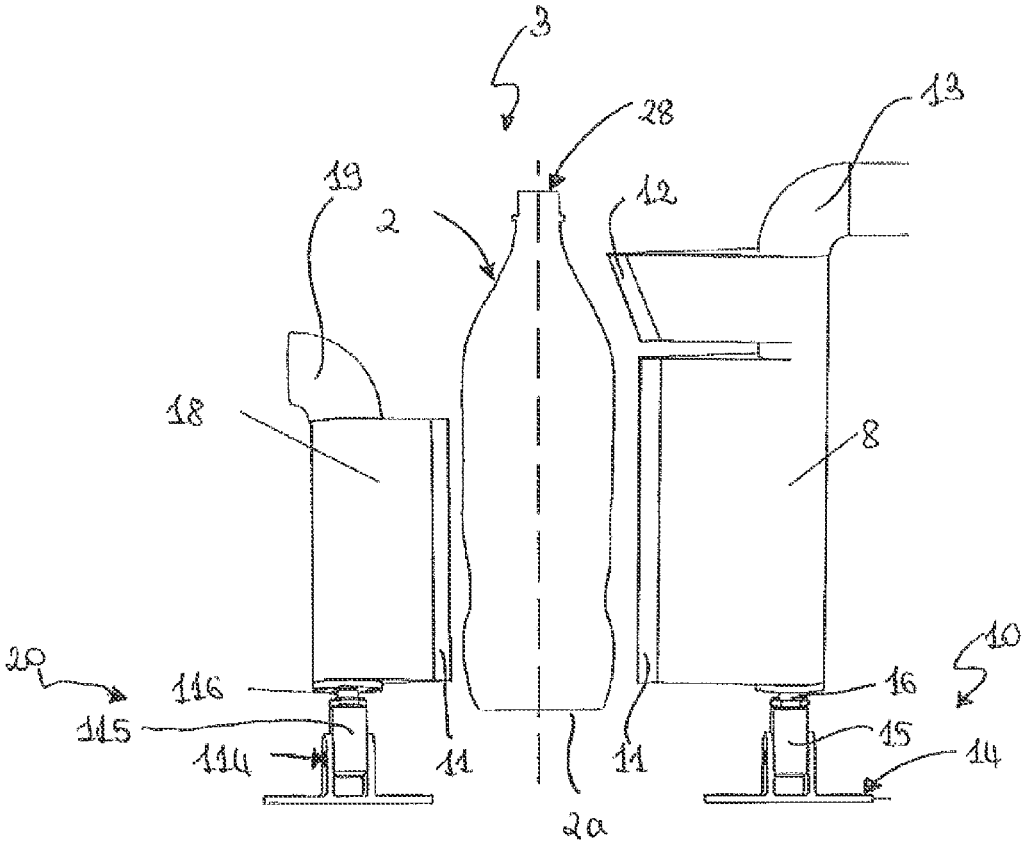
FIG. 4 illustrates a part (primary dispenser and secondary dispenser) of the drying apparatus of FIG. 1 with a bottle to be treated, in a third embodiment, in a side view.
Figure 5:
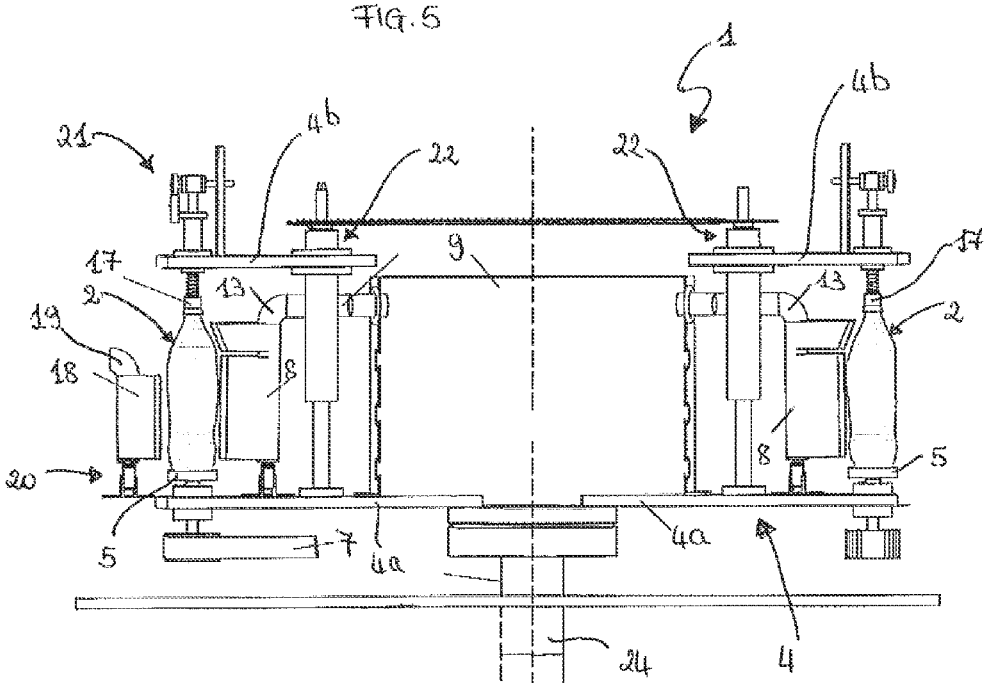
FIG. 5 illustrates the drying apparatus of FIG. 1*a*, in the third embodiment, in a side view.
Figure 6:
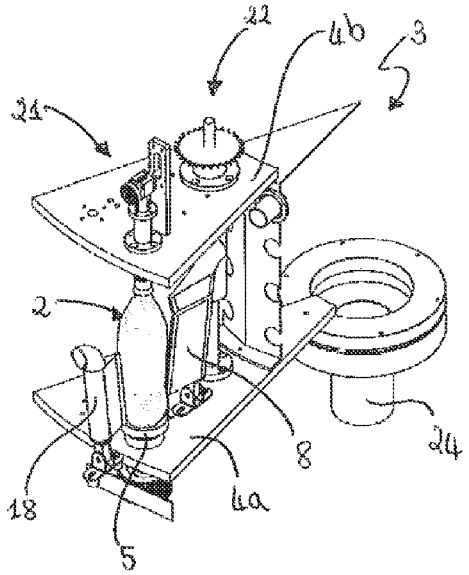
FIG. 6 illustrates a drying station of the drying appliance appearing in FIG. 5, in a perspective view from above.
Figure 7:
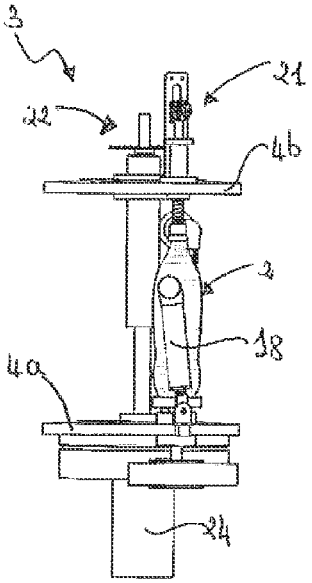
FIG. 7 illustrates the drying station of FIG. 6, in a side view.
Figure 8:
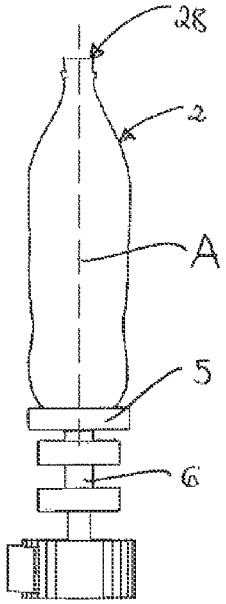
FIG. 8 illustrates a rest support and the rotation means thereof applied to a bottle, in a side view.

In a second embodiment, which is illustrated in FIGS. 3*a* to 3*c*, a pair of primary dispensers 8 is located in each drying station 3, this pair consisting of:

- a lower primary dispenser 8, suitable for sending air towards the body of the container 2 placed on the corresponding plate 5;
- an upper primary dispenser 8, suitable for sending air towards the body and towards the area of the neck 2*b* of the container 2 placed on the corresponding plate 5.

In particular, each lower primary dispenser 8*a* extends prevalently along a longitudinal direction and is provided with only one opening 11 for dispensing air towards the body of the container 2.

Each upper primary dispenser 8*b* extends prevalently along a longitudinal direction and is provided with a first opening 11 for dispensing air towards the body of the container 2 and a second opening 12 for dispensing air towards the area of the neck 2*b* of the container 2.

Preferably, the lower and upper primary dispensers 8*a*, 8*b* receive air from the distributor 9 by means of an equal number of primary lines 13. The primary lines 13 are preferably flexible.

The orientation adjustment means 10 for each lower primary dispenser 8*a* are configured in such a manner as to enable at least:

a change in the inclination of the lower primary dispenser 8*a* with respect to the lower plane surface 4*a* of the rotating carousel 4;

the rotation of the lower primary dispenser 8*a* on itself.

A change in inclination is obtained by means of a hinge constraint.

In particular, this hinge constraint is in the form of a bracket 14 that is fixed to the lower plane surface 4*a* of the rotating carousel 4 and to which a support block 15 supporting the lower primary dispenser 8*a* is hinged.

In particular, the block 15 comprises a second rotating shaft 16 that supports the lower primary dispenser 8*a*.

It is this second shaft 16 that enables the lower primary dispenser 8*a* to rotate on itself. The orientation adjustment means 10 for each upper primary dispenser 8*b* are configured in such a manner as to enable at least:

a change in the inclination of the upper primary dispenser 8*b* with respect to the upper plane surface 4*b* of the rotating carousel 4;

the rotation of the upper primary dispenser 8*b* on itself.

A change in inclination is obtained by means of a hinge constraint.

In particular, this hinge constraint is in the form of a bracket 14 that is fixed to the upper plane surface 4*b* of the rotating carousel 4 and to which a support block 15 supporting the upper primary dispenser 8*b* is hinged.

In particular, the block 15 comprises a second rotating shaft 16 that supports the upper primary dispenser 8*b*. It is this second shaft 16 that enables the upper primary dispenser 8*b* to rotate on itself.

According to an unillustrated variant, the radius of the second arc is larger than the radius of the first arc. In other words, the second arc lies outside the first arc, that is, the plates 5 are interposed between the air distributor 9 and the primary dispensers 8. The structure of the primary dispensers 8 and the orientation adjustment means 10 is similar to that described for the first embodiment (or the variant thereof) or similar to that described for the second embodiment.

In a third embodiment, which is illustrated in FIGS. 4, 5, 6 and 7, the drying apparatus 1 comprises a plurality of secondary dispensers 18 of air, located in the drying stations 3 in such a manner as to send air onto the containers 2 placed on the plates 5.

In particular, the secondary dispensers 18 are located externally of the plates 5. Preferably, the secondary dispensers 18 are integrally mounted on the rotating carousel 4.

In this sector, these secondary dispensers 18 are also known by the technical term "lances".

The number of secondary dispensers 18 is preferably equal to the number of drying stations 3. For this reason, there is a primary dispenser 8 (or a pair of primary dispensers 8*a*, 8*b*, i.e., a lower and an upper primary dispenser) and a secondary dispenser 18 in each drying station 3.

Preferably, each secondary dispenser 18 extends prevalently along a longitudinal direction and is provided with only one opening 11 for dispensing air towards the body of the container 2 placed on the plate 5.

Preferably, the secondary dispensers 18 receive air from the distributor 9 by means of an equal number of secondary lines 19. The secondary lines 19 are preferably flexible.

Advantageously, adjustment means 20 for adjusting the orientation of the secondary dispensers 18 are provided for the purpose of changing the direction of the jet of air with respect to the containers 2.

The orientation adjustment means 20 for each secondary dispenser 18 is configured in such a manner as to enable at least:

a change in the inclination of the secondary dispenser 18 with respect to the lower plane surface 4*a* of the rotating carousel 4;

the rotation of the secondary dispenser 18 on itself.

A change in inclination is obtained by means of a hinge constraint.

In particular, this hinge constraint is in the form of a bracket 114 that is fixed to the lower plane surface 4*a* of the rotating carousel 4 and to which a support block 115 supporting the secondary dispenser 18 is hinged.

In particular, the block 115 comprises a second rotating shaft 116 that supports the secondary dispenser 18. It is this second shaft 116 that enables the secondary dispenser 18 to rotate on itself.

Gripping means 17 for gripping the bottles 2 are comprised in the embodiments described and illustrated herein.

In particular, the gripping means 17 for each drying station 3 consist of a spring-loaded bell that is operatively active on a cap 28 applied to the mouth of the bottle 2 so as to keep the latter rested on the plate 5 in the drying station 3.

Each spring-loaded bell 17 is moved linearly towards or away from the cap 28 by means of a cam mechanism 21 (of a known type) positioned on the upper plane surface 4*b* of the rotating carousel 4.

The plates 5 preferably follow the entire circumferential length of the rotating carousel 4. In this case, the first arc becomes a complete circumference (hereinafter indicated as the first circumference).

Preferably, the primary dispensers 8 also follow the entire circumferential length of the rotating carousel 4. In this case, the second arc becomes a complete circumference (hereinafter indicated as the second circumference). This situation is illustrated for example in FIGS. 1*a* and 1*b*.

Preferably, the drying apparatus 1 comprises:

a screw feeder 25 for synchronization of the containers 2 coming from a belt conveyor 26;

an inlet star wheel 27 that receives the containers 2 from the screw feeder 25 and delivers them to the plates 5;

an exit star wheel 29 that receives the dried containers 2 and transfers them to the next unit.

An integrated treatment plant, for example for drying and labelling containers 2, is indicated by the number 100.

Several variants of the integrated plant 100 are illustrated in FIGS. 11-16.

In these figures, the integrated plant 100 comprises the proposed apparatus for drying 1 and an apparatus 30 for labelling the containers 2, the labelling apparatus 30 being located downstream of the drying apparatus 1.

Preferably, the integrated plant 100 also comprises an inspection unit (unillustrated).

In FIGS. 11 to 16, the integrated plant 100 comprises a labelling apparatus 30 of the rotating carousel type.

This labelling apparatus 30 is of a type known in the prior art and shall not be described in further detail herein below.

FIG. 11 illustrates a rotating carousel 4 in which a pre-established angular portion (of angle α) is used for drying the containers 2 (i.e., it constitutes the drying apparatus 1), whereas the remaining angular portion is used for labelling the dried containers 2 (i.e., it constitutes the labelling apparatus 30).

The operation of the drying apparatus for drying the containers, according to the present invention, is described below with reference to the first embodiment.

The bottles 2 move forward linearly on the belt conveyor 26 and are synchronized by the screw feeder 25, which sends them to the inlet star wheel 27. The inlet star wheel 27 positions the bottles 2 on the plates 5.

Each bottle 2, once it has been positioned on the corresponding plate 5, is kept stable by means of a spring-loaded bell 17 that acts upon the bottle cap 28.

In particular, this spring-loaded bell 17 is lowered onto the cap 28 by the relative cam mechanism 21.

The hot air coming from the distributor 9 is sent to the primary lines 13 and then to the primary dispensers 8, which blow the air in the various areas of the bottles 2 (body and neck 2*b*).

The plates 5 (and thus the bottles 2 resting thereon) are rotated on themselves once or more during rotation of the rotating carousel 4.

With reference to FIGS. 12 to 16, at the end of the drying process, the dry bottles 2 are delivered to the exit star wheel 29, which transfers them to the next unit, for example to a labelling apparatus 30 or an inspection unit.

Preferably, one or more intermediate star wheels are provided downstream of the exit star wheel 29 and upstream of the next unit.

Alternatively, an additional screw feeder 31 for synchronization or belt conveyors are provided.

The characteristics of the drying apparatus for drying containers, according to the present invention, are clearly evident from the description provided, as are the advantages thereof.

In particular, the proposed drying apparatus is compact, owing to the arrangement of the drying stations and the primary dispensers of air directly on a rotating carousel.

The use of a rotating drying apparatus rather than a linear drying apparatus makes it possible to reduce the dimensions and the installed power, with speed being equal.

By way of example, consider that to dry approximately 60000 half-liter bottles per hour, a rotating carousel of a diameter of approximately 2 m and an installed power of about 25-30 kW are required.

Moreover, given that the plates are rotating about their axes, the containers expose their entire external lateral surface to the jet of air, thus avoiding the formation of skipped areas, as occurs instead in drying tunnels with linear advancement of the containers.

The possibility of adjusting the orientation of the dispensers (which can be tilted for enabling better drainage of the water on the external surface of the containers and which are rotatable on themselves) also contributes to full exposure. Therefore, the drying process is uniform throughout the entire external lateral surface of the containers, thereby ensuring optimal application of the labels.

In conclusion, the rotating drying apparatus can be easily integrated in plants in which the other units are also of a rotating carousel type (e.g. labelling or inspection units).

The invention claimed is:

1. Drying apparatus (1) for drying containers (2), comprising:

a plurality of drying stations (3);

a plurality of rest supports (5) for resting the bottom (2*a*) of said containers (2), each one of said rest supports (5) being located in a corresponding drying station (3);

rotation means (6, 7) that are operatively active on said rest supports (5) for rotating them about their axis of symmetry (A);

a plurality of primary dispensers (8) of air, located at said drying stations (3) in such a way as to send air onto the containers (2) placed on said rest supports (5);

a rotating carousel (4), said rest supports (5) being arranged along a first arc on said rotating carousel (4) in such a manner as to follow the circumferential length of said rotating carousel (4) at least for a pre-established angular portion, said primary dispensers (8) being integrally mounted on said rotating carousel (4) and extending along a second arc, which is concentric with said first arc, characterised in that it further comprises adjustment means (10) for adjusting the orientation of said primary dispensers (8) for the purpose of changing the direction of the jet of air sent onto the containers (2).

2. Drying apparatus (1) according to claim 1, wherein the radius of said second arc is smaller than the radius of the first arc.

3. Drying apparatus (1) according to claim 1 or 2, wherein said rest supports (5) follow the entire circumferential length of said rotating carousel (4) so that said first arc consists of a complete circumference, said primary dispensers (8) also following the entire circumferential length of the rotating carousel (4) so that said second arc consists of a complete circumference.

4. Drying apparatus (1) according to claim 1, further comprising an air distributor (9) located at the centre of said rotating carousel (4), said primary dispensers (8) being connected to said air distributor (9).

5. Drying apparatus (1) according to claim 1, wherein said orientation adjustment means (10) are configured in such a manner as to enable a change at least in the inclination of each primary dispenser (8) with respect to the rotating carousel (4) and the rotation of the primary dispenser (8) on itself.

6. Drying apparatus (1) according to claim 1, wherein each one of said primary dispensers (8) is located in a corresponding drying station (3), each one of said primary dispensers (8) extending prevalently along a longitudinal direction and being provided with a first opening (11) for dispensing air towards the body of the container (2) placed on the corresponding rest support (5) and with a second opening (12) for dispensing air towards the area of the neck (2*b*) of the container (2) placed on the corresponding rest support (5).

7. Drying apparatus (1) according to claim 1, wherein in each drying station (3) there is a lower primary dispenser (8*a*) sending air towards the body of the container (2) placed on the corresponding rest support (5) and an upper primary dispenser (8*b*) for sending air towards the body and towards the area of the neck (2*b*) of the container (2) placed on the corresponding rest support (5).

8. Drying apparatus (1) according to claim 1, further comprising a plurality of secondary dispensers (18) located in said drying stations (3) in such a way as to send air onto the containers (2) placed on said rest supports (5), said secondary dispensers (18) being located externally of said rest supports (5).

9. Drying apparatus (1) according to claim 1, further comprising gripping means (17) for gripping the containers (2), said gripping means (17) consisting of a plurality of spring-loaded bells, each one of said spring-loaded bells (17) being operatively active on a cap (28) applied to the mouth of the corresponding container (2) so as to keep said container (2) rested on the rest support (5) in the corresponding drying station (3).

10. Drying apparatus (1) according to claim 1, comprising:

a belt conveyor (26) for conveying said containers (2);

a screw feeder (25) for synchronization of the containers (2) coming from said belt conveyor (26);

an inlet star wheel (27) suitable for receiving the containers (2) from the screw feeder (25) and delivering them to said rest supports (5);

an exit star wheel (29) suitable for receiving the dried containers (2) from said rest supports (5).

11. Integrated treatment plant (100) for treating containers (2), comprising:

a drying apparatus (1) for drying containers (2) according to claim 1;

a labelling apparatus (30) or an inspection apparatus for inspecting said containers (2) and located downstream of said drying apparatus (1).

* * * * *